US005457819A

United States Patent [19]

Aoki

[11] Patent Number: 5,457,819

[45] Date of Patent: Oct. 17, 1995

[54] BASEBALL GLOVE HAVING AN ADJUSTABLE WRIST PROTECTOR

[75] Inventor: Akio Aoki, Osaka, Japan

[73] Assignee: Trion Corporation, Japan

[21] Appl. No.: 38,609

[22] Filed: Mar. 29, 1993

[51] Int. Cl.[6] ..... A63B 71/14

[52] U.S. Cl. ..... 2/19; 2/161.1

[58] Field of Search ..... 2/19, 159, 160, 2/161.1, 162, 16, 910, 170, 917

[56] References Cited

U.S. PATENT DOCUMENTS

| | | | |
|---|---|---|---|
| 952,556 | 3/1910 | Yeager et al. | 2/19 |
| 1,102,552 | 7/1914 | Sell | 2/19 |
| 2,113,934 | 4/1938 | Denkert | 2/19 |
| 2,746,050 | 5/1956 | Goldsmith | 2/19 |
| 3,576,036 | 4/1971 | Latina | 2/19 |
| 4,065,813 | 1/1978 | Hudson | 2/19 |
| 4,346,481 | 8/1982 | Latina | 2/19 |
| 4,651,345 | 3/1987 | Latina | 2/19 |
| 4,891,845 | 1/1990 | Hayes | 2/19 |
| 5,214,798 | 6/1993 | McLaughlin | 2/19 |

FOREIGN PATENT DOCUMENTS

| | | | |
|---|---|---|---|
| 56-46780 | 2/1981 | Japan | 2/19 |

*Primary Examiner*—Jeanette E. Chapman
*Assistant Examiner*—Larry D. Worrell, Jr.
*Attorney, Agent, or Firm*—Webb Ziesenheim Bruening Logsdon Orkin & Hanson

[57] ABSTRACT

A baseball glove is disclosed which includes a front portion and a back portion attached to the front portion to form a hand receiving member with an opening for receiving the user's hand. A wrist closure mechanism is attached to the hand receiving member adjacent the hand receiving opening. An adjustable wrist protector is adjustably coupled to the wrist closure mechanism.

9 Claims, 2 Drawing Sheets

BASEBALL GLOVE HAVING AN ADJUSTABLE WRIST PROTECTOR

BACKGROUND OF THE INVENTION

1. Field of the Invention

The present invention relates to baseball gloves and, more specifically, to baseball gloves including wrist protection devices.

2. Description of the Prior Art

In baseball, the portion of the wrist or the backhand which requires additional protection varies depending on the fielding position of the individual player. Some players, such as infielders, are positioned where they will touch the runner with the glove, while outfielders will hit the glove against the fence or against the artificial or natural turf while attempting to catch the ball. Consequently, the various different positions require protection in different portions of the backhand or wrist. Aside from the aspect of protecting the wrist and the backhand, the comfort or fit of the user's hand when inserted into the glove varies from individual to individual. A baseball glove should provide good balance, stability and comfort to the user.

A conventional glove, as shown in U.S. Pat. No. 3,576,036 does not adequately provide for the various wrist or backhand protection or to alterations in fitting the individual user due to inherent disadvantages in the wrist fastening structure.

The object of the present invention is to overcome the aforementioned drawbacks.

SUMMARY OF THE INVENTION

The present invention provides a baseball glove which includes a front portion and a back portion attached to each other to form a hand receiving member having an opening for receiving the user's hand. A wrist closure mechanism is attached to the hand receiving member adjacent the hand receiving opening. An adjustable wrist protector is adjustably coupled to the wrist closure mechanism.

In a preferred embodiment of the present invention, the wrist closure mechanism includes a strap fastened to the back portion of the hand receiving member adjacent a first side of the back portion. A loop is attached to the back portion adjacent a second side of the back portion with the strap extending through the loop. Connecting members are attached to the strap and in a corresponding location on the back portion, wherein the adjustable wrist protector is slideably received on the strap to be slideably adjustable substantially along the entire length of the hand receiving opening. The adjustable wrist protector is positioned in the interior of the hand receiving member.

The connecting members provide for a plurality of connecting positions between the strap and the back portion, thereby providing for a varying degree of adjustability to the baseball glove of the present invention. The connecting members may be formed of corresponding strips of a hook and loop type fastener, such as Velcro®. Alternatively, the connecting members may be formed as snap members attached to the strap and a plurality of corresponding snap members attached to the back portion.

These and other features of the Applicant's invention will become apparent in connection with the foregoing description of the preferred embodiment in connection with the attached drawings, wherein like reference numerals represent like characters throughout.

BRIEF DESCRIPTION OF THE DRAWINGS

In the drawings which illustrate the best mode presently contemplated for carrying out the present invention.

DESCRIPTION OF THE PREFERRED EMBODIMENTS

Figure 1:
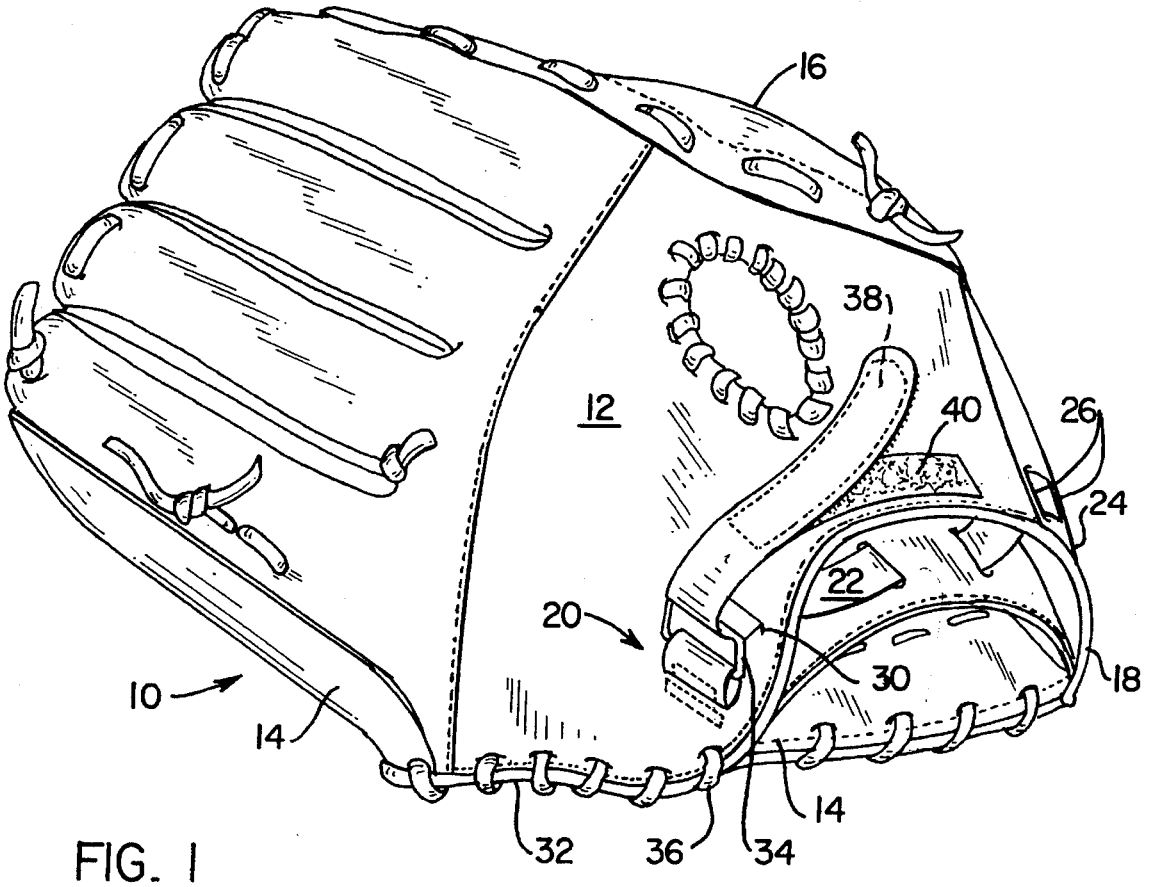
FIG. 1 is a perspective view of the baseball glove of the present invention.

FIG. 1 illustrates a baseball glove 10 according to the present invention. The baseball glove includes a back portion 12 and a front portion 14 which are attached together in a conventional fashion to form a glove-like hand receiving member. A ball catching web 16 is attached to extend between the thumb and forefinger portions of the hand receiving member. The hand receiving member includes a hand receiving opening 18 for receiving the user's hand within the baseball glove 10.

Figure 2:
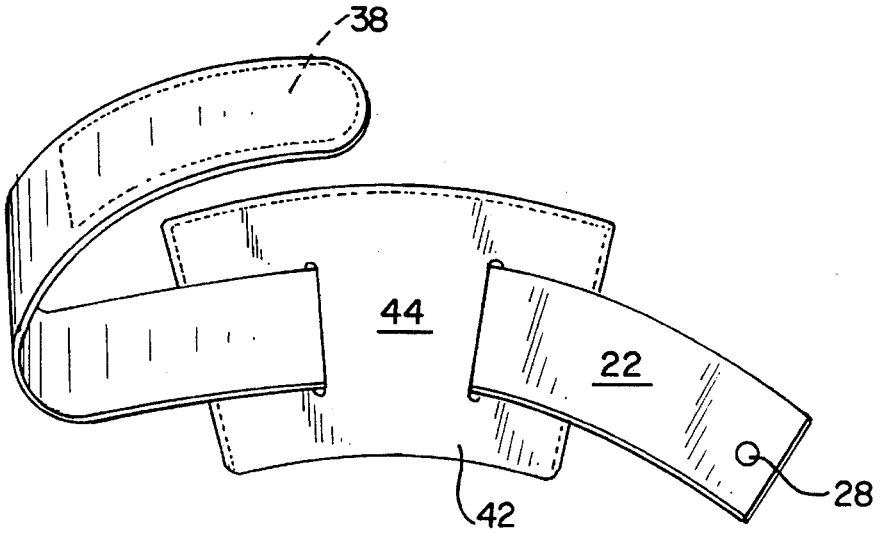
FIG. 2 is a perspective view of the wrist closure device and adjustable wrist protector shown in FIG. 1.

A wrist closure device 20 is attached to the hand receiving member adjacent the hand receiving opening 18. The wrist closure device 20 includes a strap 22 fastened to the back portion 12 adjacent a first side 24 of the back portion 12. The strap 22 is secured to the back portion 12 by being weaved through two strap securing openings 26 which are positioned in the back portion 12 adjacent the first side 24. The strap 22 can be secured to the first side 24 of the back portion 12 through use of tie down hole 28, shown in FIG. 2 and appropriate lacing (not shown).

The strap 22 extends across substantially the entire length of the hand receiving opening 18 on the interior of the hand receiving member. The strap 22 extends through a loop access opening 30 which is positioned in the back portion 12 adjacent a second side 32 of the back portion 12. The strap extends through a metal loop 34 which is attached to the exterior of the back portion 12 by a leather connecting member 36 at a position adjacent the second side 32. A strip of connecting material 38 is attached to one side of the strip 22. A strip of corresponding connecting material 40 is attached to the back portion 12 to provide for a plurality of connection positions between the strap 22 and the back portion 12. The strip of connecting material 38 and strip of corresponding connecting material 40 can be strips of hook and loop type fasteners, such as, for example, Velcro®.

An adjustable wrist protector pad 42 is slideably coupled to the strap 22 through connecting flap 44. The wrist protector pad 42 is slideably adjustable substantially along the entire length of the hand receiving opening 18.

In operation, the wrist connector pad 42 is slideably positioned along the strap 22 and the hand receiving opening 18 until it is positioned in the desired location for optimum comfort and protection. The user's hand is received within the hand receiving member through the hand receiving opening 18. The strap 22 is pulled to securely fasten the baseball glove 10, including the wrist protector pad 42, into position. The strip of connecting material 38 is then coupled to the strip of corresponding connecting material 40 to securely hold the baseball glove 10 in position. To remove the baseball glove 10, the strip of connecting material 38 is disengaged from the strip of corresponding connecting material 40, thereby allowing for loosening of the strap 22 for easy removal of the user's hand.

Figure 3:
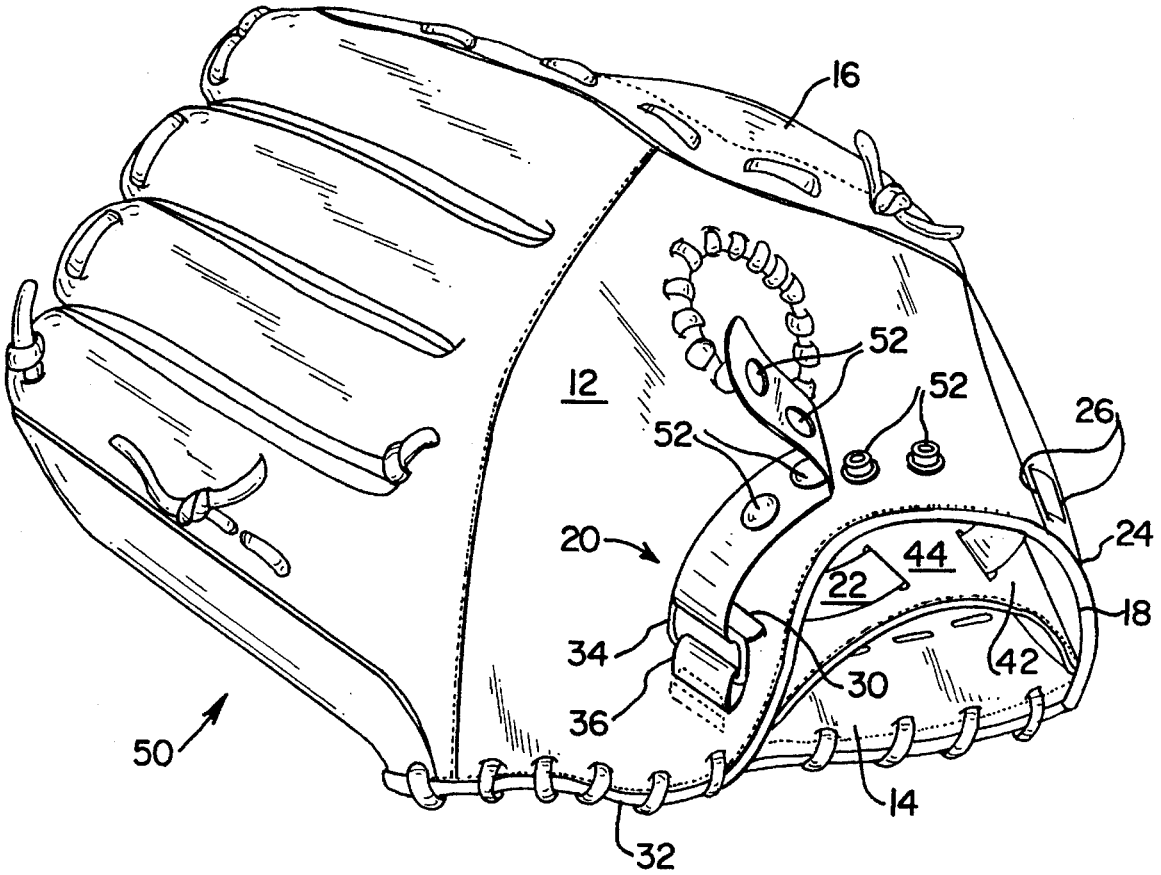
FIG. 3 is a modified embodiment of the present invention.

FIG. 3 illustrates a baseball glove 50 which is identical to the baseball glove 10 described above except that the connecting members between the strip 22 and the back portion 12 have been replaced with a plurality of snap members 52. The snap members 52 provide a plurality of connecting positions between the strap 22 and the back portion 12. In all other respects, the baseball glove 50 is identical to the baseball glove 10 described above.

While there is shown and described herein certain specific structures embodying the invention, it will be manifest to those skilled in the art that various modifications and rearrangements of the parts may be made without departing from the spirit and scope of the underlying inventive concept, and that the same is not limited to the particular forms herein shown and described except insofar as indicated by the scope of the following claims.

I claim:

1. A baseball glove comprising:

a front portion;

a back portion attached to said front portion to form a hand receiving member having an interior;

said hand receiving member having an opening for receiving a user's hand;

a wrist closure means attached to said hand receiving member adjacent said hand receiving opening; and an adjustable wrist protector means adjustably coupled to said wrist closure means, whereby said wrist protector means is adjustably positioned entirely within said interior and within said opening for receiving a user's hand and said wrist protector means is along said wrist closure means independent of said hand receiving member.

2. A baseball glove comprising:

a front portion;

a back portion attached to said front portion to form a hand receiving member having an interior;

said hand receiving member having an opening for receiving a user's hand;

a wrist closure means attached to said hand receiving member adjacent said hand receiving opening, wherein said wrist closure means includes a strap fastened to said back portion adjacent a first side of said back portion, a loop attached to said back portion adjacent a second side of said back portion with said strap extending through said loop, and connecting members attached to said strap and said back portion; and an adjustable wrist protector means adjustably coupled to said wrist closure means, wherein said adjustable wrist protector means is positioned entirely within said interior and within said opening and is slideably received on said strap to be slideably adjustable substantially along the entire length of said hand receiving opening independent of said hand receiving member.

3. The baseball glove of claim 2 wherein said connecting members provide for a plurality of connecting positions between said strap and said back portion.

4. The baseball glove of claim 3 wherein said connecting members include corresponding strips of hook and loop type fasteners.

5. The baseball glove of claim 3 wherein said connecting members include at least one corresponding set of snap members.

6. The baseball glove of claim 2 wherein said back portion includes two strap securing openings adjacent said first side which receive a first end of said strap to fasten said strap to said back portion.

7. The baseball glove of claim 6 wherein said strap extends substantially along the entire length of said hand receiving opening in the interior of said hand receiving means.

8. The baseball glove of claim 7 wherein said back portion includes a loop access opened adjacent said second side which receives said strap to guide said strap to said loop which is positioned on the exterior of said back member.

9. The baseball glove of claim 8 wherein said adjustable wrist protector means is positioned in the interior of said hand receiving member.

* * * * *